United States Patent [19]

Fujita et al.

[11] Patent Number: 4,545,303

[45] Date of Patent: Oct. 8, 1985

[54] MONORAIL CONVEYOR SYSTEM

[75] Inventors: Shigeyoshi Fujita, Suita; Naoyuki Kiuchi, Ibaraki; Tomoyuki Sasaki, Amagasaki; Kazuyoshi Fukuhara, Kashiwara, all of Japan

[73] Assignee: Daifuku Co., Ltd., Japan

[21] Appl. No.: 624,577

[22] Filed: Jun. 26, 1984

[51] Int. Cl.[4] ..... E01B 25/22

[52] U.S. Cl. ..... 104/93; 104/110; 105/96; 105/150; 192/2; 192/9

[58] Field of Search ..... 104/89, 93, 95, 106, 104/110; 105/148, 150, 152; 192/2, 9; 238/149

[56] References Cited

U.S. PATENT DOCUMENTS

| | | | |
|---|---|---|---|
| 1,766,310 | 6/1930 | Schaum | 192/2 |
| 3,625,158 | 12/1971 | Lorenz | 104/93 |
| 4,393,785 | 7/1983 | Hörtnagel | 104/93 |

FOREIGN PATENT DOCUMENTS

| | | | |
|---|---|---|---|
| 0092608 | 11/1983 | European Pat. Off. | 104/89 |
| 0553540 | 6/1932 | Fed. Rep. of Germany | 238/149 |
| 2607631 | 3/1977 | Fed. Rep. of Germany | 104/89 |
| 2508949 | 1/1983 | France | 104/93 |

*Primary Examiner*—Randolph A. Reese
*Assistant Examiner*—Dennis C. Rodgers
*Attorney, Agent, or Firm*—Webb, Burden, Robinson & Webb

[57] ABSTRACT

A monorail conveyor system in which an automotive cart comprising a drive wheel, a drive motor for driving the drive wheel, a gear case where output of the driving motor is reduced, and centering rollers rotatable on vertical axes, receives electric currents and control signals from a hollow rail and travels along the hollow rail. The driving motor has an output shaft extending in the forward-rearward direction of travel.

5 Claims, 6 Drawing Figures

MONORAIL CONVEYOR SYSTEM

BACKGROUND OF THE INVENTION

This invention relates to a monorail conveyor system and more particularly to a conveyor system in which an automotive cart having a driving motor travels along a single rail.

A monorail conveyor system as above is installed, for example, in an automobile assembly plant. In order to convey automobile frames and the like within a limited space the automotive cart per se should desirably have as compact a construction as possible. It is also desirable to permit the automotive cart to travel safely without sidewise rolling or swinging relative to the rail.

Such an automotive cart driven by a driving motor according to the prior art comprises a drive mechanism having large dimensiones in a direction normal to the rail, requiring a broad traveling space for the cart. At the same time the known cart tends to roll or swing sideways to a great extent as it travels along, which is dangerous.

SUMMARY OF THE INVENTION

An object of this invention is to eliminate the disadvantages of the known monorail conveyor system as noted above.

A monorail conveyor system according to this invention comprises a rail having a vertically elongated section, a drive wheel rotatable on the rail, a rotary shaft extending horizontally and transversely and rigidly connected to the drive wheel, a gear case supporting the rotary shaft, a cart frame including the gear case, a driving motor disposed at one of forward and rearward sides of the gear case and having a drive shaft extending in a forward-rearward direction, a reduction gear mechanism housed in the gear case and operatively connecting the drive shaft of the driving motor to the rotary shaft, and centering rollers attached to the cart frame to be rotatable on vertical axes and engageable with both lateral sides of the rail, wherein the rail includes a hollow top part on which the drive wheel rotates, a hollow bottom part contacted by the rollers, and a hollow vertical wall portion connecting the top part to the bottom part, at least the top part including a pair of inner partition walls extending from a mid-position transversely of an upper wall of the top part to right and left lateral side walls of the vertical wall portion, respectively.

The above monorail conveyor system according to this invention has the following advantages: The space required for the running route of the automotive cart is much narrower than the case of the prior art. This is made possible by a synergistic effect produced by the features that the rail employed has a vertically elongated section, that the gear case supporting the drive wheel in engagement with a top part of the rail is mounted on the cart frame disposed laterally of the rail, that the driving motor is disposed fowardly or rearwardly of the gear case with a drive shaft thereof extending in the forward-rearward direction, and that centering rollers are attached to the cart frame to be rotatable on vertical axes and engageable with both lateral sides of a bottom part of the rail. Moreover, the centering rollers are vertically spaced long apart from the drive wheel, which is effective to positively prevent the automotive cart from rolling or swinging sideways relative to the rail thereby permitting the cart to travel safely.

Other advantages of this invention will be apparent from the following description.

BRIEF DESCRIPTION OF THE DRAWINGS

The drawings illustrate a monorail conveyor system according to this invention, in which.

DETAILED DESCRIPTION OF THE PREFERRED EMBODIMENTS

Figure 1:
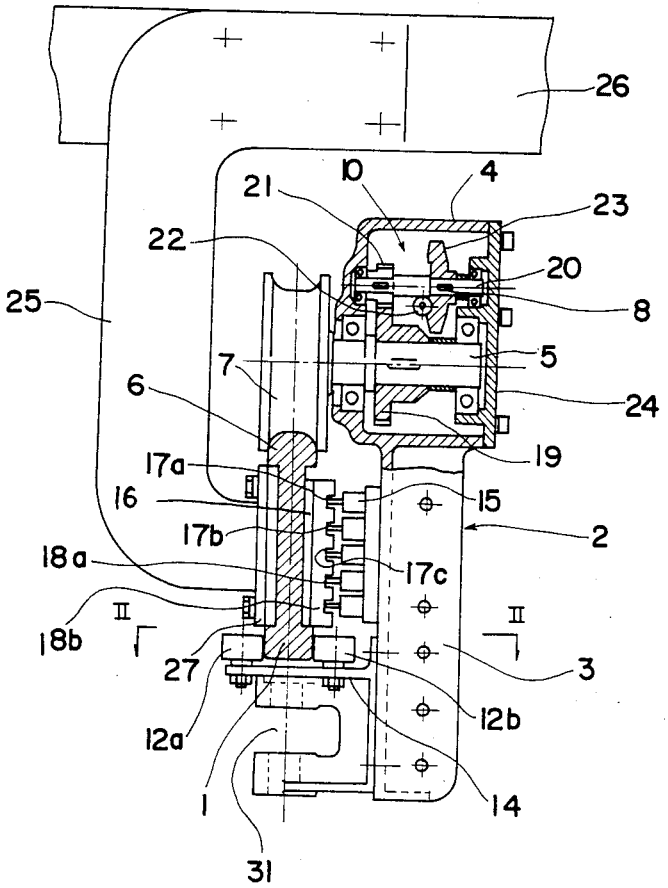
FIG. 1 is a front view partly in vertical section of a principal portion of the conveyor system.
Figure 2:
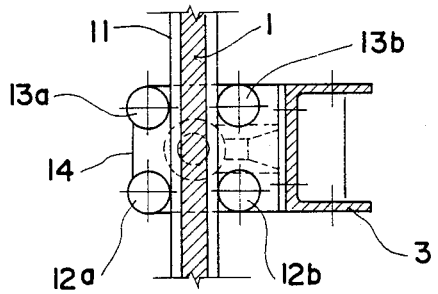
FIG. 2 is a sectional view taken on line II—II of FIG. 1.
Figure 3:
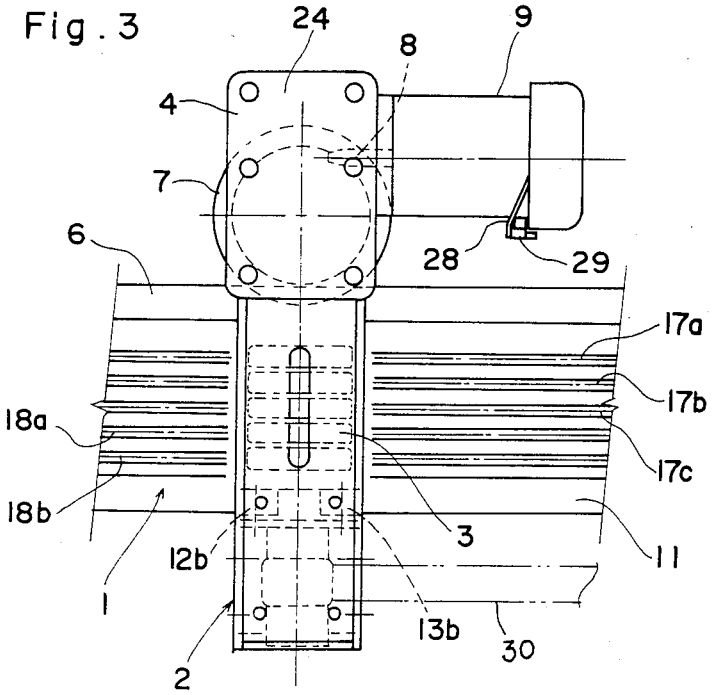
FIG. 3 is a side view of the principal portion.

Referring to FIGS. 1 through 3, the monorail conveyor system comprises a rail 1 having a vertically elongage section and an automotive cart 2. The automotive cart 2 comprises a vertically elongage frame 3 located on one side of the rail 1, a gear case 4 mounted on top of the frame 3, a rotary shaft 5 supported by the gear case 4 and extending horizontally and transversely to a position above the rail 1, a grooved drive wheel 7 attached to the rotary shaft 5 and placed in engagement with a top part 6 of the rail 1, a driving motor 9 attached to a forward side or a rear side of the gear case 4 with an output shaft 8 extending in the forward-rearward direction, a reduction gear mechanism 10 operatively connecting the output shaft 8 to the transverse rotary shaft 5, two paris of right and left centering rollers 12*a*, 12*b* and 13*a*, 13*b*, one pair being disposed forwardly of the other, supported by a bracket 14 at one lateral side of a lower portion of the frame 3 to be rotatable on vertical axes and engageable with both lateral sides of a bottom part 11 of the rail 1, and an electric current collector 15 mounted on a lateral position of the frame 3 opposed to the rail 1. The electric current collector 15 includes collector elements in sliding contact with electric conductor rails 17*a*–17*c* and control signal transmitter rails 18*a*, 18*b* arranged parallel and one above another along one lateral side of the rail 1 by means of a bracket 16. The driving motor 9 is powered by electricity taken from the conductor rails 17*a*–17*c* is under automatic remote control effected on the ground by means of the signal transmitter rails 18*a*, 18*b*.

The reduction gear mechanism 10 housed in the gear case 4 includes a large spur gear 19 mounted on the transverse rotary shaft 5, a small spur gear 21 mounted on an intermediate shaft 20 parallel with the rotary shaft 5 and in mesh with the large spur gear 19, a hypoid gear 22 mounted on the drive shaft 8 of the motor 9, and a hypoid wheel 23 mounted on the intermediate shaft 20 and in mesh with the hypoid gear 22. The gear case 4 is provided with a cover plate 24 which is removably attached thereto at a side away from the drive wheel 7, and supports one end of the rotary shaft 5 and one end of the intermediate shaft 20. Removal of the cover plate 24 permits maintenance, inspection and repair to be carried out on the reduction gear mechanism 10 in the gear case 4. It also permits the large spur gear 19 and the small spur gear 21 to be changed in order to obtain different reduction ratios.

Number 25 denotes brackets arranged at suitable intervals along the rail 1 to support the rail 1 at a predetermined height in the air. Each of the brackets 25 is attached at its top to a beam 26 on the ceiling and at its bottom, through a plate 27, to the other lateral side of the rail 1, namely the side where the electric conductor rails 17*a*–17*c* and the signal transmitter rails 18*a*, 18*b* are not disposed.

Figure 4:
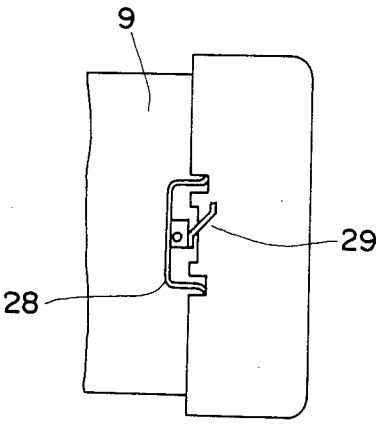
FIG. 4 is a bottom view of a principal portion of a driving motor.
Figure 5:
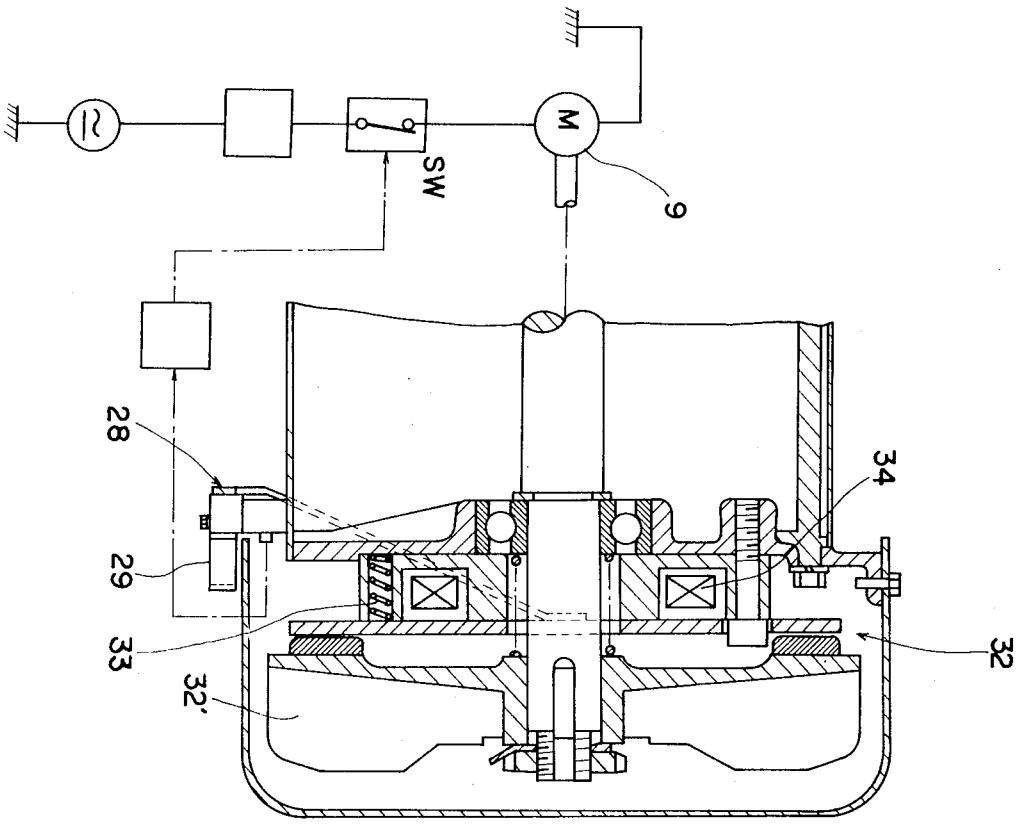
FIG. 5 is a view in vertical section of the principal portion of the driving motor and a block diagram showing an interlocking mechanism.

Referring to FIGS. 4 and 5, the driving motor 9 is provided with an internal brake mechanism 32 including a manual release means. The brake mechanism 32 applies a braking force by means of a spring 33, which is releasable when a magnet 34 is energized. Therefore, the braking action is automatically taken when the electric current is cut. The brake is also releasable by manually operating a brake release lever 28. Number 29 denotes a detector for detecting the brake release lever 28 in a release position. When the detector 29 detects the lever 28 in the release position, a switch circuit as shown in FIG. 5, which is itself known, is operated to cut the electric current in order to put the motor 9 out of operation, thereby establishing an interlocking.

According to the described construction, the motor 9 is operable by the electricity supplied through the conductor rails 17*a*–17*c* and the collector 15 when the brake release lever 28 of the motor 9 is in a position not detected by the detector 29. Rotation of the output shaft 8 is transmitted to the horizontal and transverse intermediate shaft 20 in a greatly reduced ratio effected by the hypoid gear 22 and the hypoid wheel 23. The rotation of the intermediate shaft 20 is then transmitted to the horizontal and transverse rotary shaft 5 and to the drive wheel 7 in a further reduced ratio effected by the small spur gear 21 and the large spur gear 19. The rotation of the drive wheel 7 causes the automotive cart 2 to travel along the rail 1. When the electric supply for the motor 9 is cut, the cart 2 comes to a stop. At this time the drive wheel 7 is held against free rotation since the internal brake mechanism 32 of the motor automatically acts and locks the output shaft 8. Thus the automotive cart 2 is locked in a position where it has stopped. When it is necessary to manually move the automotive cart 2 standing still, the brake release lever 28 is manually operated to release the internal brake mechanism 32 of the motor 9.

The automotive cart 2 shown in FIGS. 1 through 3 may, for example, be coupled by a connecting rod 30 shown in a phantom line in FIG. 3 to a free cart movably supported by the rail 1 rearwardly (or forwardly) of the automotive cart 2, thereby to be used as a conveyor to articles along the rail 1 as suspended from the connecting rod. In this instance the connecting rod 30 may be retained by a vertical rod by utilizing a holder portion 31 formed integrally with the bracket 14 as shown in FIG. 1. Furthermore, the cart 2 may comprise a pair of overturn stopper rollers attached to the frame 3 through a bracket to be rotatable on horizontal axes and in engagement with an underface of the bottom part 11 of the rail 1, one of the overturn stopper rollers being located forwardly and the other rearwardly of a position right under an axis of the drive wheel 7. This construction permits the automotive cart 2 shown in FIGS. 1 through 3 to be usable on its own as a drive means to push or pull a movable conveyor body which is guided by a guide rails extending parallel to the rail 1, for example, or as a conveyor to carry articles as suspended from the bracket 3.

The described construction has the following advantages:

(A) The lateral side of the rail opposite to the lateral side along which the automotive cart frame runs, provides large area for attaching brackets to suspend the rail or to support the rail on the floor. This feature permits the rail to be supported with a high degree of rigidity.

(B) The lateral side of the rail along which the cart frame runs provides a good vertical range in which the electric conductor rails and the signal transmitter rails may be arranged parallel to one another in the vertical direction, and these electric conductor and signal transmitter rails may be supported with ease.

(C) The use of the hypoid gear as a right angle power transmission means which is necessitated by the position of the motor forwardly or rearwardly of the car frame, is superior in transmission efficiency to the case of employing a worm gear, and facilitates lubrication also.

(D) Since the motor having the internal brake mechanism is used along with the use of the hypoid gear as described, the drive wheel is automatically braked when the drive wheel is freed from the drive by the motor, as where a worm gear is used, to stop the automotive cart at a certain position safely even on a sloping track.

(E) Since the brake may be released manually when the electric supply for the motor is cut, the automotive cart standing still may be moved as desired unlike the case where a worm gear is used. This facilitates arrangement of the carts in storage lines or the like.

(F) Since the brake of the motor may be released manually as described, the automotive cart may inadvertently be started by the motor while the brake is kept off, which is very dangerous. However, the invention provides the detector for establishing an interlocking to render the motor inoperative when the brake of the motor is released, whereby the automotive cart is driven safely with a desired braking function available at all times.

Figure 6:
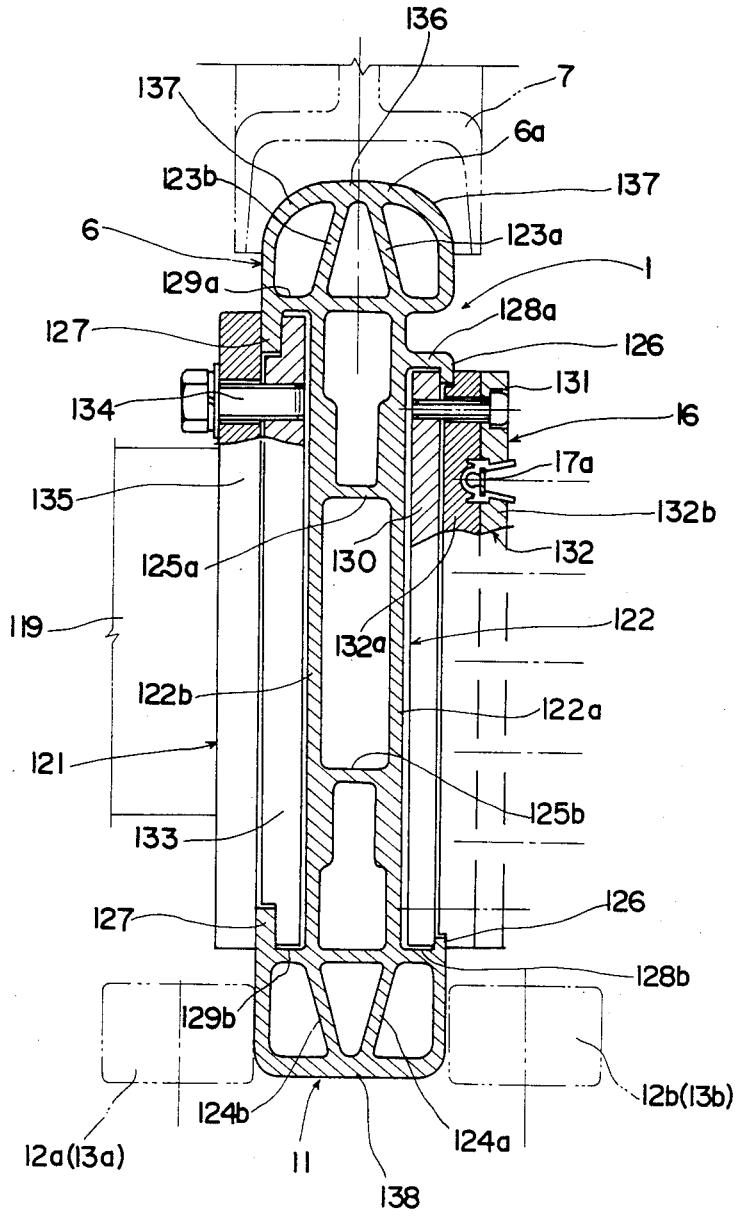
FIG. 6 is a front view in vertical section of a modified rail.

A modified example of the rail 1 for supporting and guiding the automotive cart 2 will be described hereinafter with reference to FIG. 6. As shown in FIG. 6, the modified rail 1 comprises a hollow top part 6 which is engaged by the drive wheel 7 of the automotive cart 2, a hollow bottom part 11 contacted by the guide or centering rollers 12*a*–13*b* of the cart 2, and a vertical wall portion 122, which also has a hollow construction, connecting the top part 6 and the bottom part 11. At least the top part 6 includes a pair of inclined inner partition walls 123*a*, 123*b* extending from a mid-position transversely of an upper wall 6*a* of the top part 6 to the lower wall of top part 6 where that wall is connected to right and left vertical side walls 122*a* and 122*b* of the vertical wall portion 122.

In the illustrated embodiment, the hollow bottom part 11 also includes a pair of inclined inner partition walls 124*a* and 124*b* similar to the partition walls 123*a* and 123*b*. The vertical wall portion 122 includes lateral inner partition walls 125*a* and 125*b* at vertically intermediate positions (two positions in the illustrated embodiment) extending between the right and left vertical side walls 122*a* and 122*b*.

The vertical wall portion 122 further includes continuous projections 126 and 127 extending toward one another to define two pairs of upper and lower engagement grooves 128*a*, 128*b*, 129*a* and 129*b*. The bracket 16 for supporting the electric conductor rails 17*a*–17*c* and the signal transmitter rails 18*a* and 18*b* comprises a base plate 130 having upper and lower ends fitted in the upper and lower engagement grooves 128*a* and 128*b*, and a support plate 132 secured to an outer face of the base plate 130 by bolts 131, the support plate 132 supporting the electric conductor rails and the signal transmitter rails. With the base plate 130 and the support plate 132 having the continuous projections 126 in between, the bracket 16 is fixable to any desired position longitudinally of the rail 1. The support plate 132 consists of an inner plate 132*a* and an outer plate 132*b*, and the electric conductor rails 17*a*–17*c* and the signal transmitter rails 18*a* and 18*b* are secured between the inner and outer plates 132*a* and 132*b*. The plate 121 to which the rail supporting bracket 119 is attached consists of an inner plate 133 having upper and lower ends fitted in the pair of upper and lower engagement grooves 129*a* and 129*b*, respectively, and an outer plate 135 secured to the bracket 119 and also secured to an outer face of the inner plate 133 by bolts 134. With the inner plate 133 and the outer plate 135 having the continuous projections 127 in between, the bracket 119 is fixable to any desired position longitudinally of the rail 1.

The rail according to this invention may be constructed as described above having a vertically elongate section. Therefore, where the automotive cart 2 has the grooved drive wheel 7 in engagement with the top part 6 of the rail 1 and the centering rollers 12*a*–13*a* rotatable on vertical axes and in contact with the right and left lateral sides of the bottom part 11 of the rail 1, the centering rollers 12*a*–13*b* may be sufficiently spaced apart from the drive wheel 7 in order to effectively prevent any sidewise swing of the cart 2 and permit the cart 2 to travel in a stable manner. The described configuration of the rail 1 also provides large spaces on both lateral sides thereof for attaching the bracket for the electric conductor and signal transmitter rails and the bracket for supporting the rail 1, and facilitates attachment thereof to the rail 1.

While the rail 1 in FIG. 6 is very light owing to its hollow construction, the hollow top part 6 is positively protected against crushing under a great load acting downwardly from the drive wheel 7 of the automotive cart 2 mounted on the top part 6, this being achieved by load distribution through the inclined partition walls 123*a*, and 123*b* which are connected to the lower wall of hollow part 6 above the juncture of the lower wall with the right and left vertical side walls 122*a* and 122*b* of the vertical wall portion 122. Therefore, the rail 1 is capable of supporting and guiding the heavy automotive cart 2 safely.

Particularly where, as in the foregoing embodiment, the vertical wall portion 122 includes the inner lateral partition walls 125*a* and 125*b* (its number being not limited), the rail 1 has sufficient strength against twisting in spite of its vertically elongate hollow construction. Furthermore, where, as in the foregoing embodiments, the grooved drive wheel is used to engage the top part 6 of the rail 1, the upper wall 6*a* may have such a cross-sectional shape that the mid-portion comprises a flat surface 136 and right and left sides thereof comprise bowed surfaces 137 curving downwardly, which is effective to reduce a facial pressure of the grooved wheel 7. It will be understood that the inclined partition walls 124*a* and 124*b* provided in the hollow bottom part 11 of the rail 1 are effective to prevent the hollow bottom part 11 from being crushed by the automotive cart sidewise swing stopper rollers which are rotatable on horizontal axes and press on the undersurface 138 of the hollow bottom part 11.

In the described embodiments the rail 1 is suspended from the ceiling of a building in which the conveyor system is installed. However, it is also in accordance with the present invention that the rail 1 is supported by the floor.

While preferred embodiments of the invention have been described herein, it is to be understood that it may be embodied within the scope of the appended claims.

We claim:

1. A monorail conveyor system comprising:

A. a rail (1) having
   1. a hollow top part (6),
   2. a hollow bottom part (11) and
   3. a hollow vertical wall portion (122) having spaced right and left vertical side walls (122*a* and 122*b*) connecting said top part (6) and said bottom part (11);

B. said hollow top part (6) having
   1. an upper wall (6*a*),
   2. a lower wall,
   3. spaced side walls connecting said upper wall and said lower wall and
   4. a pair of inner partition walls (123*a* and 123*b*) extending from the transverse center of said upper wall (6*a*) to said lower wall;

C. at least two lateral inner partition walls (125*a* and 125*b*) connecting said left and right vertical side walls (122*a* and 122*b*) at intermediate positions along the length thereof;

D. a drive wheel (7) rotatable on said rail (1);

E. a rotary shaft (5) extending horizontally and transversely and rigidly connected to said drive wheel (7);

F. a gear case (4) supporting said rotary shaft (5);

G. a cart frame (3) including said gear case (4);

H. a driving motor (9) having an output shaft (8) extending in a forward-rearward direction substantially parallel to said rail;

I. an intermediate shaft (20) mounted in said gear case (4) substantially parallel with said rotary shaft (5);

J. a hypoid gear (22) mounted on said output shaft (8) of said driving motor (9);

K. a hypoid wheel (23) mounted on said intermediate shaft (20) in said gear case (4) and meshing with said hypoid gear (22) on said output shaft (8); and L. a reduction gear mechanism housed in said gear case (4), said reduction gear mechanism having
   1. a small gear (21) mounted on said intermediate shaft (20) and
   2. a larger gear (19) mounted on said rotary shaft (5), whereby said driving motor (9) drives said rotary shaft (5) to rotate said drive wheel (7).

2. A monorail conveyor system as defined in claim 1 further comprising a brake mechanism (32) provided for said driving motor (9), a manual release means having a lever (28) to release braking action of said brake mechanism (32), and a detector (29) for interlocking to prevent rotation of said motor (9) when said lever (28) is in a brake release position, and wherein said reduction gear mechanism (10) includes a hypoid gear.

3. A monorail conveyor system as defined in claim 2 wherein said rail (1) includes electric conductor rails (17*a*–17*c*) and control signal transmitter rails (18*a* and 18*b*) for said driving motor (9) at least at one lateral side thereof.

4. A monorail conveyor system as defined in claim 2 wherein said hollow rail (1) includes electric conductor rails (17*a*–17*c*) and control signal transmitter rails (18*a* and 18*b*) for said driving motor (9) on at least one lateral side thereof and inclined partition walls (124*a* and 124*b*) in said hollow bottom part (11) similar to said partition walls (123*a* and 123*b*) in said hollow top part (6).

5. A monorail conveyor system as defined in claim 4 wherein said vertical wall portion (122) includes a pair of upper and lower engagement grooves (128*a* and 128*b*) defined by continuous projections (126 and 127) extending toward one another, said electric conductor rails (17*a*–17*c*) and said signal transmitter rails (18*a* and 18*b*) being provided on a support plate (132), said support plate being secured to a base plate (130) by bolts (132), and said plate (130) being fitted in said engagement grooves (128*a* and 128*b*).

* * * * *